US006298899B1

(12) United States Patent
Baltz et al.

(10) Patent No.: US 6,298,899 B1
(45) Date of Patent: Oct. 9, 2001

(54) WATER JACKET CORE

(75) Inventors: Gene Frederic Baltz, Olmsted Falls, OH (US); Edwin Allen Krenz, Dearborn; Jeffrey Carl Jowett, Ann Arbor, both of MI (US); James R. Lapeus, Aurora, OH (US); Warren L. Kellner, Commerce Township, MI (US)

(73) Assignee: Ford Global Tech., Inc., Dearborn, MI (US)

( * ) Notice: Subject to any disclaimer, the term of this patent is extended or adjusted under 35 U.S.C. 154(b) by 0 days.

(21) Appl. No.: 09/352,363

(22) Filed: Jul. 13, 1999

(51) Int. Cl.[7] ..... B22C 9/00
(52) U.S. Cl. ..... 164/28; 164/369
(58) Field of Search ..... 164/28, 369

(56) References Cited

U.S. PATENT DOCUMENTS

| | | | |
|---|---|---|---|
| 4,284,041 | 8/1981 | Rasch et al. | 123/193 H |
| 5,188,071 | 2/1993 | Han | 123/195 R |
| 5,320,158 | 6/1994 | Helgesen | 164/76.1 |
| 5,860,469 | 1/1999 | Barlow | 164/98 |

FOREIGN PATENT DOCUMENTS

| | | | | |
|---|---|---|---|---|
| 248755 | * | 8/1987 | (DE) | 164/369 |
| 6-45982 | * | 10/1985 | (JP) | 164/28 |
| 62-168638 | * | 7/1987 | (JP) | 164/369 |
| 64-83336 | * | 3/1989 | (JP) | 164/369 |
| 6-47492 | * | 2/1994 | (JP) | 164/28 |

* cited by examiner

*Primary Examiner*—Nam Nguyen
*Assistant Examiner*—I.-H. Lin
(74) *Attorney, Agent, or Firm*—Ford Global Tech., Inc.

(57) ABSTRACT

A water jacket 10 which includes an outer core 12 and a plurality of pre-formed bridge cores 14. The water jacket 10 allows for the selective creation of cylinder bores 16 which have a substantially uniform and circular cross sectional area.

11 Claims, 2 Drawing Sheets

WATER JACKET CORE

FIELD OF THE INVENTION

This invention relates to a water jacket core and more particularly, to a water jacket core which is formed and/or created by the use of at least one pre-formed bridge core member.

BACKGROUND

Engine cylinder blocks typically include water jackets or passages which generally surround the various cylinder bores and which allow water or coolant to selectively flow around the periphery of the cylinder bores in order to cool the bores. Water jackets therefore allow the heat resulting and/or generated from the combustion processes occurring within the cylinder bores to be dissipated, thereby substantially preventing undesirable heat related structural deformation and/or damage to the cylinder bores and/or to the engine block.

These water jackets are typically formed by the use of a core which is operatively used within the engine block foundry/casting process to form these water/coolant passages or grooves. Particularly, these water jacket cores include an outer portion and one or more "bridge" portions or "bridge" members which are used to form portions of the cylinder bore walls (e.g., those portions positioned between adjacent cylinder bores). These water jacket bridge members therefore define the shape and the size of the created or formed coolant passages which are formed between cylinder bores. The bridge members also ensure that water and/or coolant is allowed to flow between the cylinder bores, thereby increasing the amount by which the bores are selectively cooled.

Typically, each of these water jacket cores are manufactured within a "core box" which defines the desired shape of the core. Particularly, the core box is filled with a mixture of commercially available sand and a commercially available heat curing resin, and is heated at a relatively high temperature until a substantially solidified and cured core is created. Alternatively, the contained sand/resin is "chemically" cured by the use of a chemical catalyst, such as triethylamine ("TEA"), which is selectively placed within the core box and which "sets" or hardens the resin. Once the core is solidified or "set", the core box is opened, "parted" and/or separated, in order to allow the created core to be removed for use in the engine block casting process. There are a number of drawbacks associated with these prior water jacket cores and with their method of manufacture.

First, in order for a core box to be "parted" or separated without substantially damaging the enclosed core, the outer core surfaces and bridge core surfaces must have or form a "draft angle" or an "angle of inclination" of at least one degree with reference to an axis which is perpendicular to the direction in which the main core box is parted. These "draft angles", which are required in order to manufacture the core, result in the creation of relatively thick central core sections residing or formed near the core box parting line and relatively thin core sections formed within those portions of the water jacket remote from the parting line. Particularly, these relatively thick core sections substantially limit or reduce the thickness of the mid-sections or central portions of the created cylinder bore.

After the casting process is complete, as is known, the draft angle of the cores cause an opposite or complementary "angle" to be created and/or formed upon the created cylinder bores. Particularly, this causes each of the created cylinder bores to have a thinner cross-section at their respective mid-sections or mid-portions and a thicker cross-section at their respective top and bottom surfaces. The resultant thin cross-section adversely effects the overall structural integrity of the cylinder bore walls. The thin cross-section of the cylinder bore walls further adversely limits the amount of combustion created pressure which may be produced in the formed engine block without structurally damaging the cylinders. Moreover, the thin cross-section of the bore-walls influences and more particularly, adversely effects or impacts the overall length which may be achieved by the designed cylinder block architecture.

Another drawback related to these prior water jacket cores and their respective method of manufacture is that they do not generally allow for a desirable and substantial increase in the diameter of the cylinder bores. That is, due to the structural limitations of these prior cores and core boxes (e.g., the strength of the core material and draft angle required to be created in these bridge portions), a bridge portion having a minimum thickness of less than 0.139 inches cannot generally be produced (e.g., adjacent outer cylinder bore walls are separated by about 0.139 inches). Therefore, in order to desirably increase the diameter of the cylinder bores (e.g., to increase the power, torque and/or efficiency of the engine), the centers of the bores must be spaced further apart, thereby undesirably increasing the overall length and size of the engine. Another potential alternative is to make the cylinder bore walls thinner, thereby allowing the size or the diameters of the cylinder bores to be increased without increasing the overall length and size of the engine. This potential alternative is undesirable since it substantially and structurally weakens the cylinder bore walls and increases their susceptibility to heat related damage and/or structural deformation.

Another prior technique for increasing the diameter of the cylinder bores is to eliminate the bridge areas within the water jacket core. Unfortunately, this alternative undesirably eliminates the water cooling passages between the cylinder bores. This configuration (i.e., adjacently formed cylinders having no water passages between the cylinders) is typically referred to as a "Siamese" cylinder bore assembly or a "Siamese" type cylinder block. While this approach does increase the cylinder bore diameter, it does not permit the bores to be fully and evenly cooled, thereby potentially causing undesirable heat related cylinder bore metal deformation and/or damage.

There is therefore a need to provide a water jacket core which is formed by a process which allows the water jacket and the formed cylinder block to overcome the various and previously delineated drawbacks of the prior art; which is relatively thinner than typical water jacket cores; and which further includes relatively thin bridge portions, thereby allowing for the use of larger cylinder bores which are substantially and uniformly cooled without increasing the overall engine block architecture.

SUMMARY OF THE INVENTION

It is a first object of the invention to provide a water jacket core which overcomes some or all of the previously delineated drawbacks of prior water jacket cores.

It is a second object of the invention to provide a water jacket core which is substantially thinner than prior water jacket cores and which allows for the use of and/or for the selective formation of relatively larger cylinder bores without a concomitant increase in the overall length and/or size of the cylinder block or the engine, and without substantially and structurally degrading the integrity of the created and/or formed cylinder block.

It is a third object of the invention to provide a water jacket core which has a relatively thin bridge portions and which overcomes some or all of the previously delineated drawbacks.

It is a fourth object of the invention to provide a water jacket core which is relatively thinner than prior cores and which does not substantially increase the time, expense, or complexity required to "machine" the cylinder block casting and which does not substantially increase the time and expense to manufacture the created/formed water jacket core.

According to a first aspect of the present invention, a water jacket core assembly is provided. The water jacket core assembly includes an outer core and at least one bridge core which is formed separate and apart from the outer core and which selectively cooperates with the outer core to form the water jacket core assembly.

According to a second aspect of the present invention, a method of producing a water jacket core is provided. The method includes the steps of forming at least one bridge core; and forming an outer core around the at least one bridge core, thereby causing the formed outer core to be cooperatively joined with the at least one bridge core and to cooperatively form the water jacket core.

These and other objects, aspects, features, and advantages of the present invention will become apparent from a consideration of the following specification and by reference to the attached drawings.

DETAILED DESCRIPTION OF THE PREFERRED EMBODIMENT OF THE INVENTION

Figure 1:
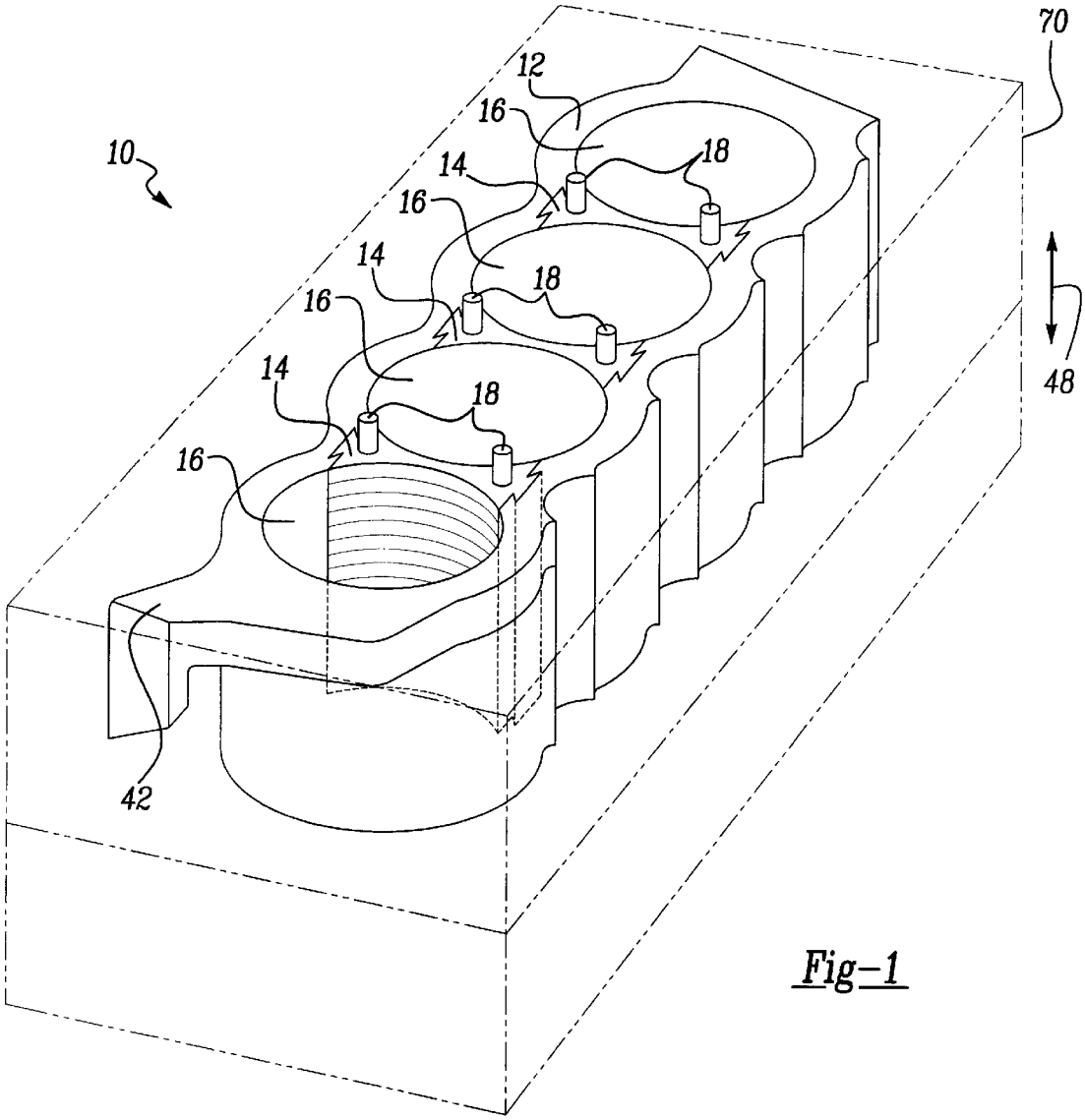
FIG. 1 is a perspective view of a water jacket core which is made in accordance with the teachings of the preferred embodiment of the invention.
Figure 2:
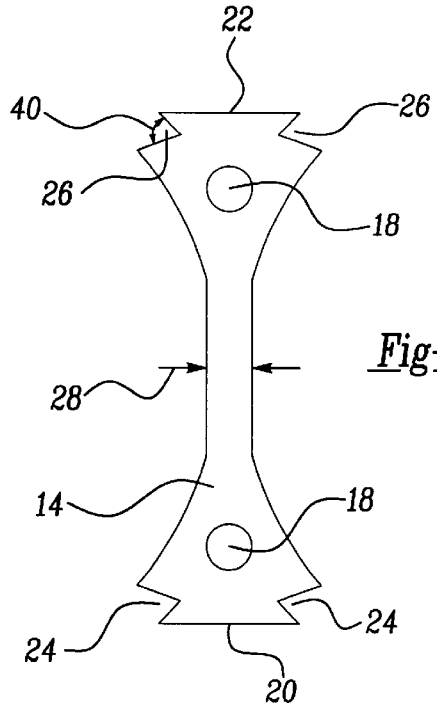
FIG. 2 is a top view of a pre-formed bridge core member which is used within the water jacket core shown in FIG. 1.
Figure 3:
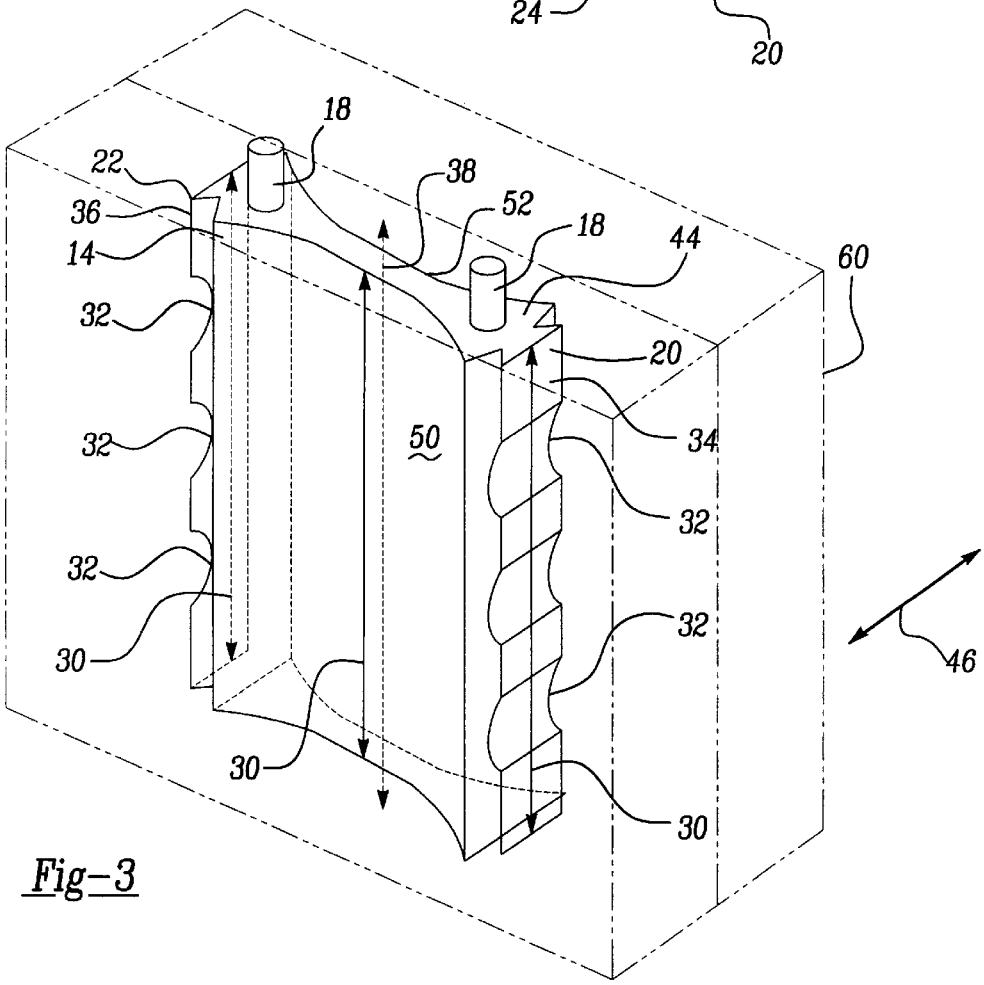
FIG. 3 is a perspective view of the pre-formed bridge core member which is shown in FIGS. 1 and 2.

Referring now to FIGS. 1–3, there is shown a water jacket core assembly 10 or "main" water jacket core assembly which is made in accordance with the teachings of the preferred embodiment of the invention and which is adapted to allow an engine cylinder block to be desirably created and/or formed. As shown, water jacket core assembly 10 includes an outer core portion 12 and three substantially identical pre-formed bridge cores 14. In the most preferred embodiment of the invention, pre-formed bridge cores 14 are separately created and/or "pre-formed", apart from core assembly 10, and then selectively used to form the water jacket core assembly 10.

These pre-formed bridge portions or members 14 are attached to and integrally formed within the outer core 12 and cooperate with outer core 12 to form four substantially identical bores 16 which are used to create cylinders of substantially the same size and shape, each of the created cylinders having a substantially uniform and circular cross-sectional area. Core 10 further includes an integrally formed core "print" portion 42 which outwardly projects from the periphery of outer core 12 and which is adapted to selectively hold and/or position core 10 within a typical core package or casting mold. While only a single water jacket core assembly 10 is shown, it should be appreciated that multiple water jacket core assemblies 10, each being substantially similar to core assembly 10, may be used to selectively and desirably produce an engine having more than four cylinders. Accordingly, by way of example and without limitation, multiple water jacket core assemblies 10 may selectively be used to create engines or engine blocks having two or more parallel cylinder blocks.

As best shown in FIGS. 2 and 3, each pre-formed bridge core 14 has a substantially "hour glass" shaped cross-sectional area which, in one non-limiting embodiment of the invention, has a width 28 of about six-one-hundredths of an inch (0.06') at its thinnest portion, which lies approximately midway between respective and opposed ends 20 and 22. The length 30 of each core 14 is substantially constant from each respective end 20 to end 22. Each of the ends 20 and 22 respectively include a pair of substantially identical and opposed "V"-shaped notches or grooves 24, 26 which are longitudinally coextensive with core 14. In one non-limiting embodiment, the interior angle 40 of each of the "V"-shaped grooves 24, 26 is approximately 45 degrees. Importantly, opposed cylinder bore creating surfaces 50, 52 are substantially smooth and form respective and substantially parallel longitudinal axis of symmetry 38. Therefore, surfaces 50, 52 each have substantially "no draft angle".

Each pre-formed bridge core member 14 further includes a pair of substantially cylindrical steam vents 18. Each of the vents 18 are located upon a unique one of the respective top surfaces 44 proximate to a unique one of respective ends 20, 22. Vents 18 are, in the preferred embodiment of the invention, also accurate dimensional locators for the water jack manufacturing or forming process (e.g., vents 18 may be used to properly position core 10 within a conventional assembly used to create an engine block). Each pair of the vents 18 extend from a unique top surface 44 of a member 14 in a direction substantially parallel to the respective longitudinal axis of symmetry 38 of the member 14. Each end 20, 22 contains several substantially identical and integrally formed notches or semi-circular concave indentations or recessed portions 32 which are distributably spaced along and are longitudinally coextensive to respective surface 34, 36.

In the most preferred embodiment of the invention, bridge portions 14 are "pre-formed". That is, bridge portions or cores 14 are selectively and separately formed and/or created apart from the outer core 12 and the main water jacket assembly 10. This "pre-formation" allows the bridge portions 14 to be desirably created without a draft angle.

Particularly, bridge cores or bridge portions 14 are created by use of commercially available high temperature foundry sand. This sand selectively contains a conventional and commercially available resin or resin compound which is "blown" into a core box 60 and which is subsequently cured with a catalyst. In the preferred embodiment of the invention, cores 14 are "chemically" cured by the addition of TEA to the core box, or are cured by a thermal-setting resin type core box.

Bridge core members 14 are each preferably and individually fabricated in a core box 60 which is adapted to be selectively opened, separated, or "parted" in the direction of arrow 46, such that the core box parts and/or separates along an axis which is substantially parallel to the longitudinal axis 38 of the core 14. This longitudinal separation allows bridge ore 14 to be formed with a relatively thin center thickness 28 and substantially smooth and parallel surfaces 50, 52. The "pre-formed" bridge cores 14 have substantially "no draft angle" along or within surfaces 50, 52. In the preferred embodiment of the invention, bridge portions 14 are further coated with a conventional high temperature refractory coating after being formed and removed from the core box, thereby further strengthening cores 14. In other non-limiting invention embodiments, bridge cores 14 may be formed by other known core making processes such as the "shell core process", the "hot box process," or the "cold-box process".

Once the bridge cores or bridge members 14 have been formed and/or created (e.g. once the bridge cores 14 have been "pre-formed"), in one non-limiting embodiment, they are selectively and operatively placed and/or arranged into the respective positions shown in FIG. 1 within a second or "main" core box 70. The outer core 12 is then created and/or formed within the main core box by "blowing" conventional foundry sand and/or resin into the main core box 70 and around the operatively positioned and selectively contained bridge cores 14. This formation process integrally joins the contained bridge cores 14 to the outer core 12, thereby allowing and causing the contained bridge cores 14 to integrally and selectively cooperate with the outer core 12 to form a water jacket assembly 10. Particularly, the "V" shaped grooves 24, 26 and the indentations 32 become substantially filled with the sand and/or resin which is "blown" into the main core box 70 and allows the bridge cores 14 to be integrally formed and/or coupled to the outer core 12. Outer core 12 is then cured, preferably by way of a chemical catalyst (e.g., TEA), thereby integrally, cooperatively and fixedly joining bridge cores 14 to outer core 12. Once the core 10 has been "set" or hardened, the main core box 70 is separated in the direction of arrow 48. Core 10 is then removed and is used in a conventional engine block casting process and creates cylinder bores having a substantially uniform and circular cross sectional area, thereby allowing the bores to be uniformly cooled with relatively thinner coolant passages between cylinder bores.

It should be appreciated that the separate fabrication and/or formation of the bridge cores or members 14, in the previously delineated manner, allows the pre-formed bridge cores 14 to be thinner in cross sectional area than prior bridge cores and to have a substantially "zero draft" angle, thereby allowing for the use of larger cylinder bores within the cylinder block without a concomitant increase in the overall length and/or size of the engine block. Furthermore, the selective and separate formation process allows the cores 14 to be fabricated or created by use of different types of sand, resin and/or materials (e.g., stronger materials) than the outer core 12 and/or allows for a different type of refractory coating to be applied to the pre-fabricated bridge cores 14 than to the outer core 12, thereby providing a relatively thin core 14 having the requisite strength, dimensional stability and thermal stability required in the casting process. As such, the created water jacket core 10 has substantially the same or improved strength than prior jackets but with a substantial reduction in thickness and requiring substantially no additional machining than prior water jackets. The overall core formation processes does not require a substantial amount of additional effort over the conventional processes.

Applicants' invention is not limited to the fabrication of a particular type of sand core, nor is Applicants' invention limited to the exact cylinder block water jacket depicted in FIG. 1. Rather, Applicants' invention may be applied to virtually any type or shape of core 10.

It is to be understood that the invention is not limited by the exact construction or method illustrated and described above but that various changes and/or modifications may be made without departing from the spirit and/or the scope of Applicants' inventions.

What is claimed is:

1. A method of producing a water jacket core comprising the steps of:

forming at least one bridge core; and forming an outer core around said at least one bridge core, thereby causing said formed outer core to be cooperatively joined with said at least one bridge core and to cooperatively form said water jacket core.

2. The method of claim 1 further comprising the step of coating said at least one bridge core with a certain high temperature refractory coating.

3. The method of claim 2 further comprising the step of coating said water jacket core with a second high temperature refractory coating.

4. The method of claim 1 wherein said step of forming said at least one bridge core comprises forming said at least one bridge core by use of the shell core process.

5. The method of claim 1 wherein said step of forming said at least one bridge core comprises forming said at least one bridge core by use of the hot-box process.

6. The method of claim 1 wherein said step of forming said at least one bridge core comprises forming said at least one bridge core by use of the cold-box process.

7. The method of claim 1 wherein said formed at least one bridge core has a substantially uniform cross-sectional area.

8. The method of claim 1 wherein said formed at least one bridge core has at least one groove.

9. The method of claim 8 wherein said at least one groove is substantially "v"-shaped.

10. The method of claim 1 wherein said bridge core includes generally thin walls.

11. The method of claim 1 wherein said step of forming at least one bridge core comprises the steps of providing a box; placing sand and resin within said box; heating said box, thereby forming said at least one bridge core having a certain longitudinal axis of symmetry; and opening said box along a direction which is perpendicular to said longitudinal axis of symmetry.

* * * * *